US006691648B2

(12) United States Patent
Beierle

(10) Patent No.: US 6,691,648 B2
(45) Date of Patent: Feb. 17, 2004

(54) RADIAL CAM DRIVEN INTERNAL COMBUSTION ENGINE

(76) Inventor: Mark H. Beierle, 1615 Parkhill Rd., Santa Margarita, CA (US) 93453

( * ) Notice: Subject to any disclaimer, the term of this patent is extended or adjusted under 35 U.S.C. 154(b) by 0 days.

(21) Appl. No.: 10/064,555

(22) Filed: Jul. 25, 2002

(65) Prior Publication Data

US 2003/0024493 A1 Feb. 6, 2003

Related U.S. Application Data

(60) Provisional application No. 60/307,578, filed on Jul. 25, 2001.

(51) Int. Cl.[7] ..... F02B 75/22

(52) U.S. Cl. ..... 123/54.3; 123/197.1

(58) Field of Search ..... 123/197.1, 197.3, 123/197.4, 54.1–54.8, 55.1–55.7

(56) References Cited

U.S. PATENT DOCUMENTS

| | | | | |
|---|---|---|---|---|
| 852,033 | A | | 4/1907 | Phillippe |
| 1,190,949 | A | | 7/1916 | Philippe |
| 1,630,273 | A | | 5/1927 | Nordwick |
| 1,730,659 | A | | 10/1929 | Johnson et al. |
| 1,735,764 | A | | 11/1929 | Johnson |
| 1,775,635 | A | | 9/1930 | Ball |
| 1,795,865 | A | | 3/1931 | Kettering |
| 1,863,877 | A | | 6/1932 | Rightenour |
| 2,120,657 | A | | 6/1938 | Tucker et al. |
| 3,274,982 | A | | 9/1966 | Masaaki et al. |
| 3,311,095 | A | | 3/1967 | Hittell |
| 3,482,554 | A | | 12/1969 | Marthins |
| 3,572,209 | A | | 3/1971 | Aldridge et al. |
| 3,931,810 | A | | 1/1976 | McGathey |
| 3,948,230 | A | | 4/1976 | Burns |
| 3,964,450 | A | | 6/1976 | Lockshaw |
| 4,011,842 | A | | 3/1977 | Davies et al. |
| 4,026,252 | A | | 5/1977 | Wrin |
| 4,128,084 | A | | 12/1978 | Sutherland |
| 4,301,776 | A | | 11/1981 | Fleming |
| 4,331,108 | A | | 5/1982 | Collins |
| 4,334,506 | A | | 6/1982 | Albert |
| 4,381,740 | A | | 5/1983 | Crocker |
| 4,459,945 | A | | 7/1984 | Chatfield |
| 4,545,336 | A | | 10/1985 | Waide |
| 4,584,972 | A | | 4/1986 | Jayne |
| 4,727,794 | A | * | 3/1988 | Kmicikiewicz ..... 91/491 |
| 4,791,898 | A | | 12/1988 | Jayne |
| 4,848,282 | A | | 7/1989 | Chaneac |
| 5,375,566 | A | | 12/1994 | Brackett |
| 5,553,574 | A | | 9/1996 | Duncalf |
| 5,560,327 | A | | 10/1996 | Brackett |
| 6,039,020 | A | | 3/2000 | Kawamoto |
| 6,164,263 | A | | 12/2000 | Saint-Hilaire et al. |

* cited by examiner

*Primary Examiner*—Noah P. Kamen
(74) *Attorney, Agent, or Firm*—Thomas F. Lebens; Sinsheimer, Schiebelhut & Baggett

(57) ABSTRACT

A radial cam driven internal combustion engine has connecting rod guide pins that slide into ends of the connecting rods, allowing the connecting rods to slide freely linearly while applying side loads on the connecting rods to the crankcase. The stationary guide pins protrude out from a center ring that floats over the central drive shaft. These pins are grooved to allow the pressure inside the connecting rod to escape. Each piston dwells at top dead center long enough to create a fixed volume environment and for all the fuel in the cylinder to be consumed.

4 Claims, 2 Drawing Sheets

RADIAL CAM DRIVEN INTERNAL COMBUSTION ENGINE

CROSS REFERENCE TO RELATED APPLICATIONS

This application claims the benefit of U.S. Provisional Patent Application No. 60/307,578, for RAD-CAM ENGINE, of Mark H. Beierle, filed Jul. 25, 2001, incorporated herein by reference.

BACKGROUND OF INVENTION

The present invention relates generally to engines, and more particularly to radial cam driven internal combustion engines.

Radial cam driven internal combustion engines have multiple cylinders located radially about a central drive shaft. The pistons operating inside the cylinders have connecting rods with rollers at one end that push against and thereby rotate a cam, as opposed to the connecting rods being attached to a crank pin and crankshaft. Radial cam driven engines have been plagued with problems related to side loading of the connecting rod due to the tangent force vector resulting from the angular contact of the connecting rod roller against the cam, especially during the power stroke (or combustion stroke). Also, especially in the area of light aircraft and Ultralight vehicles, the engines traditionally available produce excess noise, vibration and lack efficiency.

There is thus a need in the art for an efficient, quiet and smooth running radial cam driven engine that alleviates the tangential force resulting from the angular contact of the connecting rod roller against the cam.

SUMMARY OF INVENTION

The present invention advantageously addresses the needs above as well as other needs by providing an efficient, quiet and smooth running radial cam driven engine having connecting rods and connecting rod guide pins that alleviate the tangential force resulting from the angular contact of the connecting rod roller against the cam.

In one embodiment, the invention can be characterized as a radial cam driven internal combustion engine. The engine has a crankcase, a camshaft rotatably attached to the crankcase and a cam fixedly attached to the camshaft. A plurality of cylinders are located radially about the camshaft and are attached to the crankcase. A plurality of pistons are located within the cylinders and a plurality of connecting rods are each attached at a first end to an associated piston. At the second end of each connecting rod is a hollow area. Each connecting rod cam roller in a plurality of connecting rod cam rollers is rotatably attached to the second end of an associated connecting rod and is located against the cam. Also, a first end of each connecting rod guide pin in a plurality of connecting rod guide pins is located slidably inside the hollow area of an associated connecting rod. A second end of each connecting rod guide pin is fixedly attached to the crankcase.

In another embodiment, the invention can be characterized as an apparatus for use in a radial cam driven internal combustion engine comprising a connecting rod having a hollow portion in one end and a connecting rod guide pin located slidably inside the hollow area. The connecting rod guide pin is stationary and the connecting rod slides on it during operation.

In yet another embodiment, the invention can be characterized as a process of piston operation in an internal combustion engine comprising the steps of pushing a piston in a cylinder during a compression stroke with a cam of a cam driven internal combustion engine and dwelling the piston at top dead center long enough to substantially consume all fuel in the cylinder when ignited.

A better understanding of the features and advantages of the present invention will be obtained by reference to the following detailed description of the invention and accompanying drawings which set forth an illustrative embodiment in which the principles of the invention are utilized.

BRIEF DESCRIPTION OF DRAWINGS

The above and other aspects, features and advantages of the present invention will be more apparent from the following more particular description thereof, presented in conjunction with the following drawings wherein.

Corresponding reference characters indicate corresponding components in the views of the drawings.

DETAILED DESCRIPTION

The following description of the presently contemplated best mode of practicing the invention is not to be taken in a limiting sense, but is made merely for the purpose of describing the general principles of the invention. The scope of the invention should be determined with reference to the claims.

Figures 1, 2:
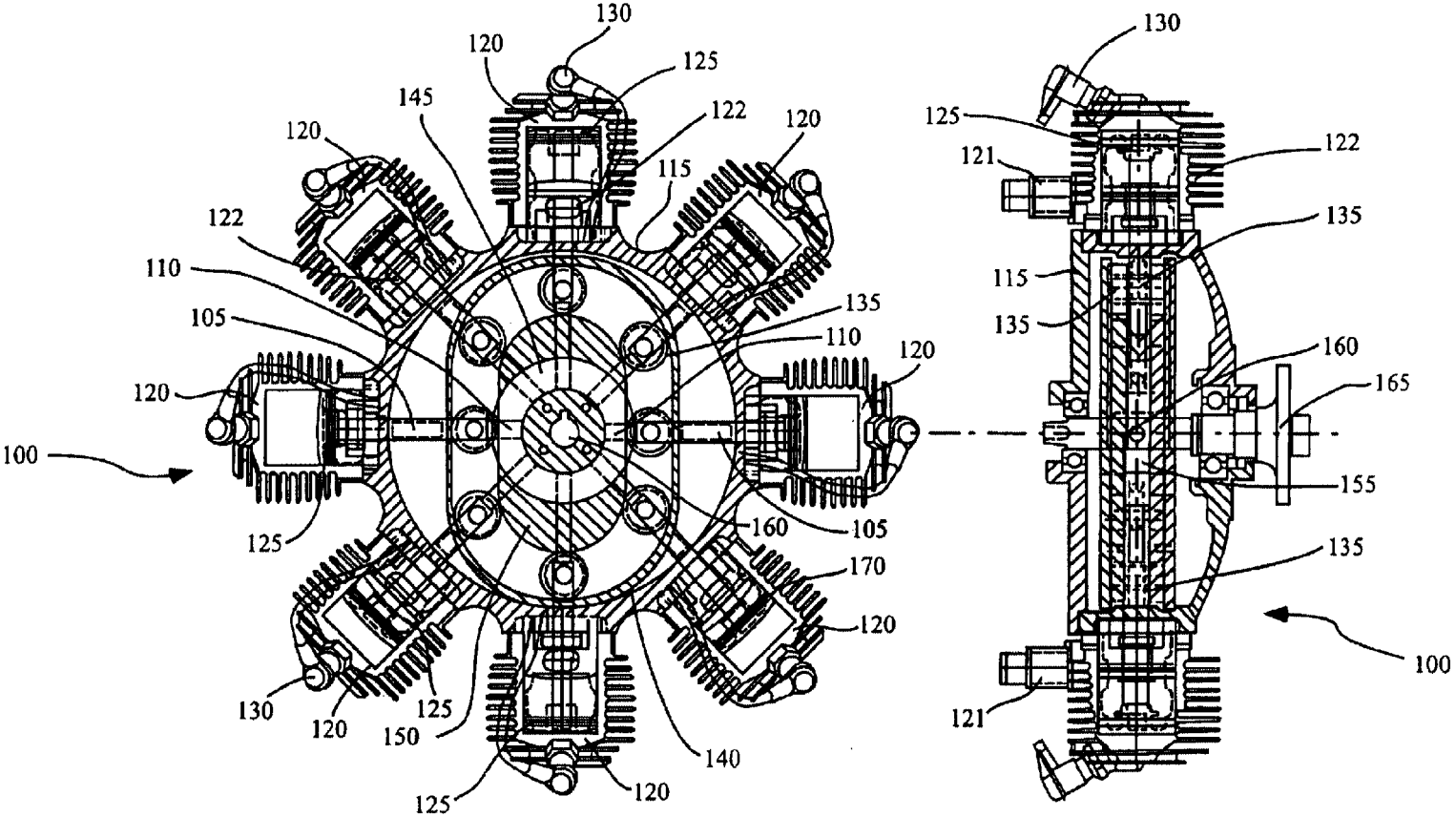
FIG. 1 is a top planar cross sectional view of a radial cam driven engine according to the present invention.
FIG. 2 is a side cross sectional view of the radial cam driven engine of FIG. 1.

Referring to FIGS. 1 and 2, shown is a top planar cross sectional view and a side cross sectional view of a radial cam driven engine 100 employing connecting rods 105 and connecting rod guide pins 110 according to one embodiment of the present invention.

Shown is a crankcase 115, a plurality of cylinders 120 (eight in this case) and associated intake 121 and exhaust ports 122, pistons 125, spark plugs 130, connecting rods 105, connecting rod cam rollers 135 and connecting rod guide pins (shown in phantom) 110. Also shown is a roller cam return track 140, a stationary guide pin ring 145, a cam 150, a cam center connector 155, a camshaft 160 and a power take off shaft 165.

Figure 3:
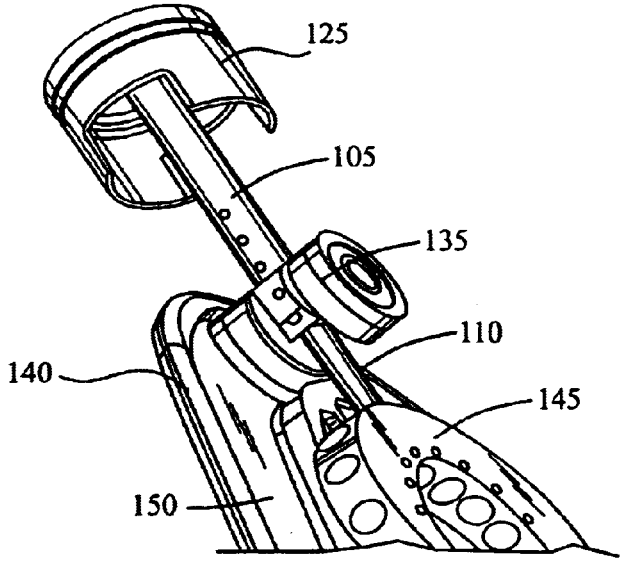
FIG. 3 is a perspective side view a single piston and rod assembly of the engine of FIG. 1.
Figure 4:
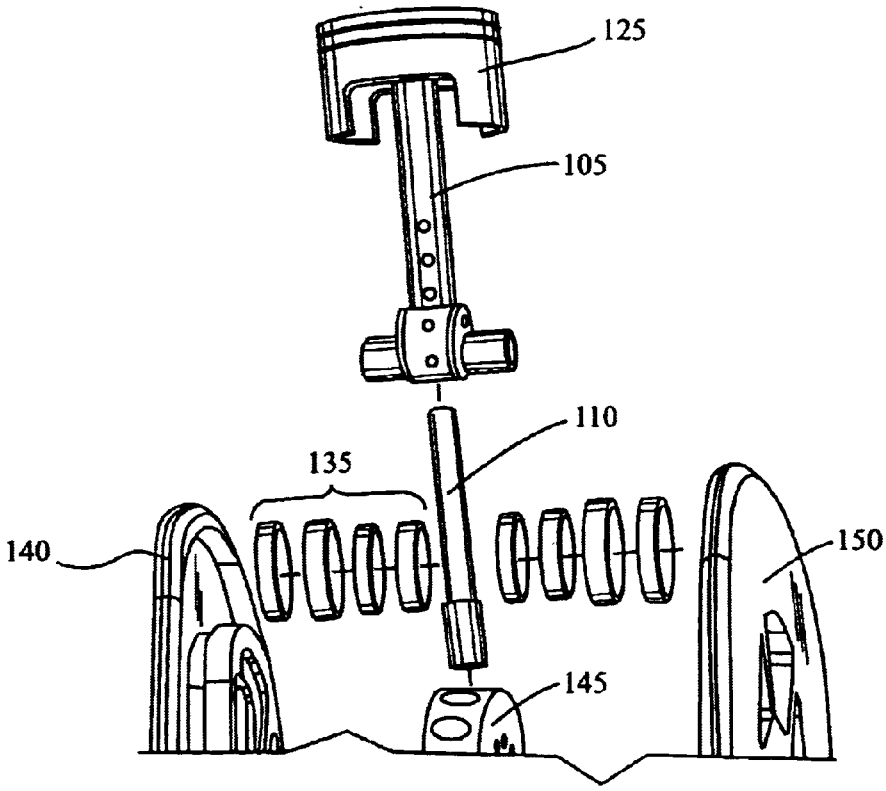
FIG. 4 is an exploded perspective side view of a single piston and rod assembly of the engine of FIG. 1.

Referring next to FIGS. 3 and 4, shown is a perspective side view and an exploded perspective side view of a single piston and rod assembly of the engine of FIG. 1. Shown are the piston 125, connecting rods 105, connecting rod cam rollers 135 and connecting rod guide pins 110. Also shown are a roller cam return track 140, a stationary guide pin ring 145 and a half of the cam 150.

Each cylinder 120 is located in the same plane radially about the camshaft 160. Each cylinder 120 also has a spark plug 130 operably attached thereto and has operable intake 121 and exhaust ports 122. The pistons 125 located within the cylinders 120 are each rigidly attached 170 to a first end of their respective connecting rods 105. A connecting rod cam roller 135 is rotatably attached on a second end of each connecting rod 105. Each connecting rod 105 is also hollow and fits slidably over a first end of a connecting rod guide pin 110. The stationary connecting rod guide pins 110 lead from each connecting rod 105 toward the center of the crankcase 115 between forward and rear halves of the cam 150, but stop short of reaching the cam shaft 160 and are securely attached at their second ends to a stationary guide pin ring 125 which is in turn attached to the crankcase 115. The connecting rod cam rollers 135 are located between the roller cam return track 140 and the cam 150. The guide pins 110 pass between the wheels of each individual roller 135 and lead into the hollow areas of the connecting rods 105. The cam 150 is fixedly attached to the camshaft 160 via the cam center connector 155 and the camshaft 160 is rotatably attached to the crankcase 115.

The engine 100 is preferably two-stroke and as each piston 125 fires during a power stroke (or combustion stroke), the associated connecting rod 105 and connecting rod cam roller 135 push against the cam 150. Simultaneously, the connecting rod 105 slides over the stationary connecting rod guide pin 110 as the cam 150 rotates. This alleviates the side loading of the connecting rod 105 due to the tangent force vector resulting from the angular contact of the connecting rod roller 135 against the cam 150, especially during the combustion stroke. The connecting rod guide pins 110 address these loads and allow the connecting rods 105 to slide freely linearly while applying the side loads to the crankcase 115. The connecting rod guide pins 110 are also grooved to allow the pressure inside the connecting rod 105 to escape. The cam 150 is 100% dynamically balanced. As each piston 125 fires, two opposing pistons are pushed so that all rotational and reciprocating forces are equally and effectively dampened out.

Each piston 125 dwells at top dead center at the end of the compression stroke long enough to create a fixed volume environment for all the fuel in the cylinder 120 to be consumed when combustion occurs. This allows the power stroke (or combustion stoke) to act as an expansion stroke cooling the spent exhaust gasses before they exit the exhaust port 122. Preferably, each piston 125 dwells at the top of the stroke for 17.5 degrees of the cam 150 rotation. The major source of noise from the exhaust is the temperature differential. The hotter the gasses entering the cold ambient air, the faster the expansion at their boundary causing a popping sound at the exhaust port 122. Since the spent exhaust gasses are cooled before they exist the exhaust port 122, the noise is significantly reduced.

The radial design of the engine 100 allows many pistons 125 to be sequentially acting on a relatively small cam 150 surface as the cam 150 rotates. Also, the power pulses are divided up and are overlapping, thereby making the engine 100 run more smoothly. Thus, there are no tortional pressure reversals as there are on conventional engines. This is very important for light aircraft since the air frames are so light that the tortional resonance that is sent up through the drive train in single and two cylinder Ultralight engines is the biggest portion of the vibration felt by the pilot.

While the invention herein disclosed has been described by means of specific embodiments and applications thereof, numerous modifications and variations could be made thereto by those skilled in the art without departing from the scope of the invention set forth in the claims.

What is claimed is:

1. A radial cam driven internal combustion engine comprising:

a crankcase;

a camshaft rotatably attached to the crankcase;

a cam fixedly attached to the camshaft;

a plurality of engine cylinders located radially about the camshaft and attached to the crankcase;

a plurality of operable pistons located within the cylinders;

a plurality of connecting rods, each connecting rod in the plurality of connecting rods attached at a first end to an associated piston and each connecting rod having a hollow area at the second end;

a plurality of connecting rod cam rollers, each cam roller in the plurality of cam rollers attached at the second end of each connecting rod and located against the cam; and a plurality of connecting rod guide pins, each connecting rod guide pin in the plurality of connecting rod guide pins located slidably inside a hollow area of an associated connecting rod at a first end of each connecting rod guide pin wherein a second end of each connecting rod guide pin is fixedly attached to the crankcase.

2. The engine of claim 1 wherein the connecting rod guide pins have grooves along the pins.

3. An apparatus for use in a radial cam driven internal combustion engine comprising:

a connecting rod having a hollow portion one end; and a connecting rod guide pin slidably inserted into the hollow area, wherein the connecting rod guide pin is stationary and on which the connecting rod slides during operation.

4. The apparatus of claim 3 wherein the connecting rod guide pin has grooves along the pin.

* * * * *